US005405277A

United States Patent [19]

Stalker

[11] Patent Number: 5,405,277

[45] Date of Patent: Apr. 11, 1995

[54] BOAT MOTOR CONVERSION APPARATUS

[76] Inventor: Harold D. Stalker, 16 Main St. N., Melbourne, Quebec, Canada, J0B 2B0

[21] Appl. No.: 209,707

[22] Filed: Mar. 14, 1994

[51] Int. Cl.[6] ..... B63H 21/26

[52] U.S. Cl. ..... 440/49; 440/900

[58] Field of Search ..... 440/28, 31, 63, 75, 440/83, 900, 49, 73, 1.3

[56] References Cited

U.S. PATENT DOCUMENTS

| | | | |
|---|---|---|---|
| 3,323,482 | 6/1967 | Sanborn | 440/31 |
| 4,450,670 | 5/1984 | Robinson | 440/73 |
| 4,604,067 | 8/1986 | Roberts | 440/900 |
| 4,752,256 | 6/1988 | Dorion | 440/49 |
| 4,976,637 | 12/1990 | Newell et al. | 440/900 |
| 5,017,167 | 5/1991 | Govan | 440/73 |
| 5,083,948 | 1/1992 | Grobson | 440/900 |

*Primary Examiner*—Stephen P. Avila

[57] ABSTRACT

A boat motor conversion apparatus for converting a line trimmer into a boat motor comprising a tube having an upper end and a lower end, the upper end adapted to be coupled to a line trimmer's motor housing; an elongated drive shaft disposed within the tube, the drive shaft having a tip end extending from the upper end of the tube and a base end extending from the lower end of the tube, the tip end adapted to be coupled to a line trimmer's drive motor, whereby the drive motor rotates the drive shaft within the tube when activated; a boat motor having a plurality of gears coupled to the base end of the drive shaft for redirecting rotational movement therefrom and a propeller coupled to the gears; and a securement mechanism coupled to the tube and adapted for securing the tube to the stern of a boat.

1 Claim, 3 Drawing Sheets

FIG. 3
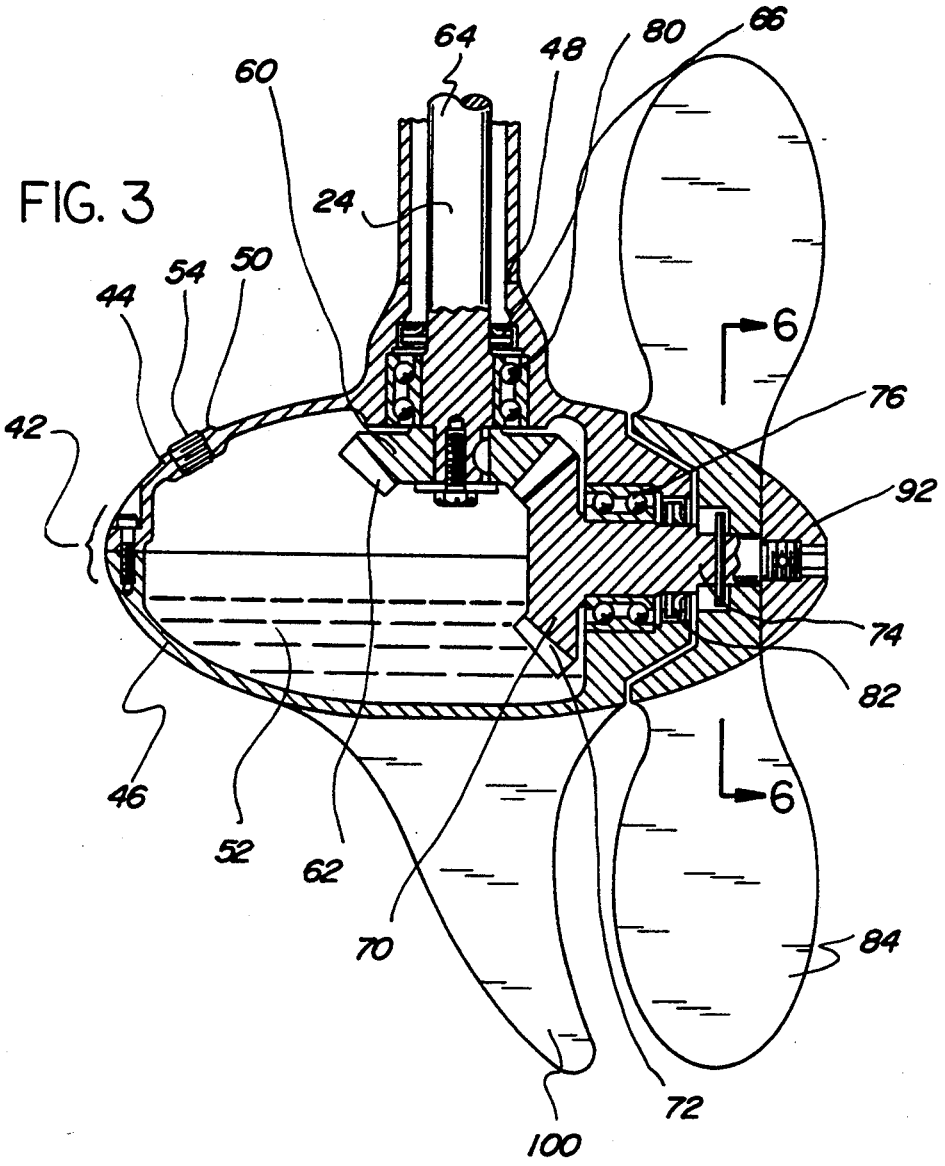
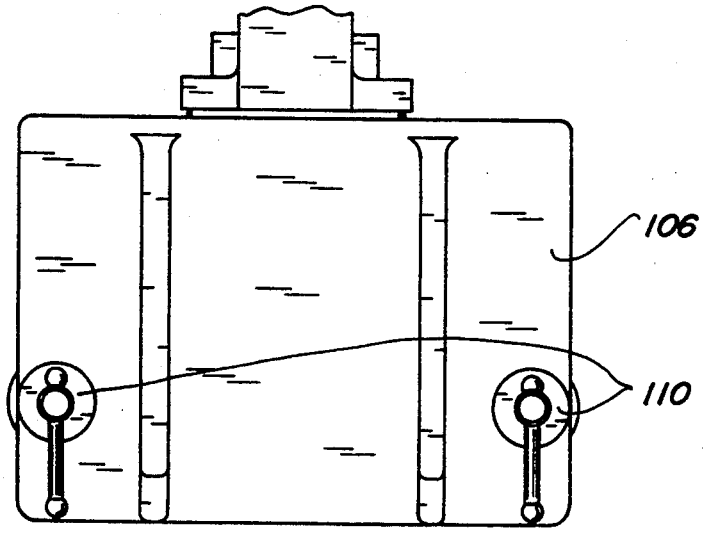
FIG. 4

BOAT MOTOR CONVERSION APPARATUS

BACKGROUND OF THE INVENTION

1. Field of the Invention

The present invention relates to a boat motor conversion apparatus and more particularly pertains to converting a line trimmer into a boat motor with a boat motor conversion apparatus.

2. Description of the Prior Art

The use of motor conversion apparatuses is known in the prior art. More specifically, motor conversion apparatuses heretofore devised and utilized for the purpose of converting line trimmers into motors are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,450,670 to Robinson discloses a weed cutter for boat motor. U.S. Pat. No. 4,604,067 to Roberts discloses a method and apparatus for converting line trimmer into a trolling motor. U.S. Pat. No. 4,976,637 to Newell et al. discloses an outboard motor conversion kit. U.S. Pat. No. 4,752,256 to Dorion discloses a boat propulsion device. U.S. Pat. No. 5,017,167 to Govan discloses a line and weed cutter. U.S. Pat. No. 5,083,948 to Grobson discloses a personal watercraft using a string trimmer or similar power source.

While these devices fulfill their respective, particular objective and requirements, the aforementioned patents do not describe a boat motor conversion apparatus that uses its own integral extension tube and a drive shaft therein with one end having a motor coupled thereto and the other end adapted to be coupled to a line trimmer drive motor for propelling a boat.

In this respect, the boat motor conversion apparatus according to the present invention substantially departs from the conventional concepts and designs of the prior art, and in doing so provides an apparatus primarily developed for the purpose of converting a line trimmer into a boat motor.

Therefore, it can be appreciated that there exists a continuing need for new and improved boat motor conversion apparatus which can be used for converting a line trimmer into a boat motor. In this regard, the present invention substantially fulfills this need.

SUMMARY OF THE INVENTION

In the view of the foregoing disadvantages inherent in the known types of motor conversion apparatuses now present in the prior art, the present invention provides an improved boat motor conversion apparatus. As such, the general purpose of the present invention, which will be described subsequently in greater detail, is to provide a new and improved boat motor conversion apparatus and method which has all the advantages of the prior art and none of the disadvantages.

To attain this, the present invention essentially comprises, in combination, an elongated and rigid tube having an upper end and a lower end, the upper end adapted to be coupled to a line trimmer's motor housing. An elongated drive shaft is disposed within the tube. The drive shaft has a tip end extending from the upper end of the tube and a base end extending from the lower end of the tube. The tip end is adapted to be coupled to a line trimmer's drive motor, whereby the drive motor rotates the drive shaft within the tube when activated. A collar is disposed around the tube and allows axial movement of the tube upwards or downwards. The collar has an upper portion and a lower portion. Each portion has a threaded aperture formed thereon and an L-shaped bolt disposed therein for coupling with the tube such that the lower end of the tube is placed in an extended position from the collar. A boat motor is provided and further includes a hollow container having an essentially concave upper portion secured to an essentially concave lower portion. A central opening is disposed on the upper portion of the container for receiving the base end of the drive shaft therein. An oblique opening is disposed on the upper portion of the container and is adapted for holding the nozzle of a oil reservoir therein. An oil reservoir is disposed within the container for holding oil for lubrication. The oil reservoir has a nozzle extending upwards through the oblique opening. The nozzle is adapted for filling the oil reservoir with oil. The boat motor includes an elongated first bevelled gear. The gear has a toothed portion on one end and a rod on the other end. The toothed portion is disposed within the oil reservoir. The rod is upwardly extended from the toothed portion through the oil reservoir and coupled to the base end of the drive shaft. The boat motor includes a first ball-bearing ring disposed within the oil reservoir and positioned around the rod of the first bevelled gear adjacent to the toothed portion thereof for allowing rotational movement of the first bevelled gear within the container when rotated by the drive shaft. The boat motor includes an elongated second bevelled gear. The gear has a toothed portion on one end and a rod on the other end. The toothed portion of the second bevelled gear is disposed within the oil reservoir and mated with the toothed portion of the first bevelled gear for perpendicularly redirecting rotational movement therefrom. The rod is horizontally extended through the oil reservoir. The boat motor includes a second ball-bearing ring disposed within the oil reservoir and positioned around the rod of the second bevelled gear adjacent to the toothed portion thereof for allowing rotational movement of the second bevelled gear within the oil reservoir when rotated by the first bevelled gear. A first seal ring is formed on the oil reservoir and positioned around rod of the first bevelled gear adjacent to the first ball-bearing ring for preventing oil from leaking from the oil reservoir. A second seal ring is formed on the oil reservoir and positioned around rod of the second bevelled gear adjacent to the second ball-bearing ring for preventing oil from leaking from the oil reservoir. The boat motor includes a propeller. The propeller has a housing disposed about the rod of the second bevelled gear adjacent to the second seal ring and four blades extending therefrom. The boat motor includes a shear pin that has a first end, a second end, and an intermediate portion therebetween with the first end and second end disposed in the housing of the propeller and the intermediate portion disposed through the rod of the second bevelled gear. The shear pin translates rotational movement from the second bevelled gear to the propeller, whereby generating propelling forces. A cap is coupled to the end of the rod of the second bevelled gear, thus securing the propeller thereto. A propeller protector is included. The propeller protector is coupled to the lower portion of the container and extends downwards therefrom for protecting the rotating propeller from damage. A clamp is included and has a first member coupled to the collar, a downwardly extending U-shaped second member, and a pivot therebetween. The second member has a pair of clamping screws threadably coupled thereto. The clamping screws are adapted for securing the stern of a boat within the second member. A handle is included and is coupled to the upper portion of the collar for allowing the boat motor to be rotated sideways and pivoted upwards and downwards with respect to the pivot of the clamp. A throttle control is coupled to the handle and is adapted for controlling the line trimmer's drive motor. A switch is coupled to the handle and is adapted for deactivating the line trimmer's drive motor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boat motor conversion apparatus which has all the advantages of the prior art motor conversion apparatuses and none of the disadvantages.

It is another object of the present invention to provide a new and improved boat motor conversion apparatus which may be easily and efficiently manufactured and marketed.

It is a further object of the present invention to provide a new and improved boat motor conversion apparatus which is of durable and reliable construction.

An even further object of the present invention is to provide a new and improved boat motor conversion apparatus which is susceptible of a low cost of manufacture with regard to both materials and labor, and which accordingly is then susceptible of low prices of sale to the consuming public, thereby making such a boat motor conversion apparatus economically available to the buying public.

Still yet another object of the present invention is to provide a new and improved boat motor conversion apparatus which provides in the apparatuses and methods of the prior art some of the advantages thereof, while simultaneously overcoming some of the disadvantages normally associated therewith.

Even still another object of the present invention is to provide a new and improved boat motor conversion apparatus for converting a line trimmer into a boat motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view of the boat motor of the present invention.

FIG. 4 is a view of the clamp taken along the line 4—4 of FIG. 2.

The same reference numerals refer to the same parts through the various Figures.

DESCRIPTION OF THE PREFERRED EMBODIMENT

Figure 1:
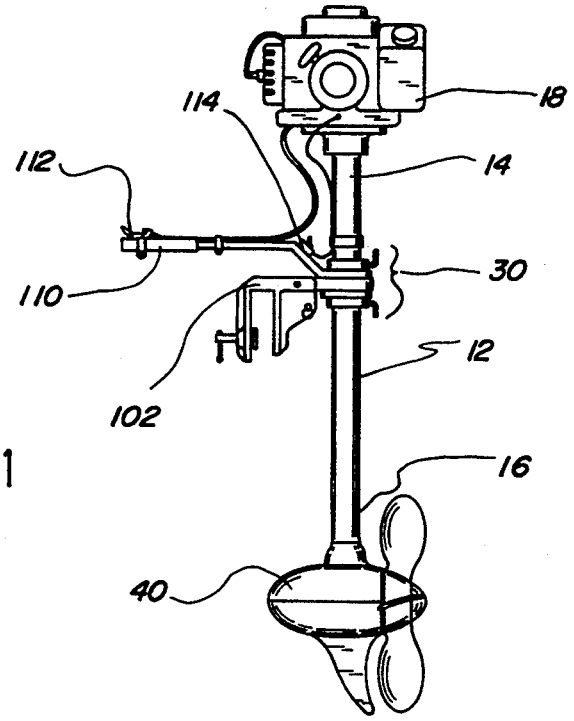
FIG. 1 is a side elevational view of the preferred embodiment of the boat motor conversion apparatus constructed in accordance with the principles of the present invention.
Figure 2:
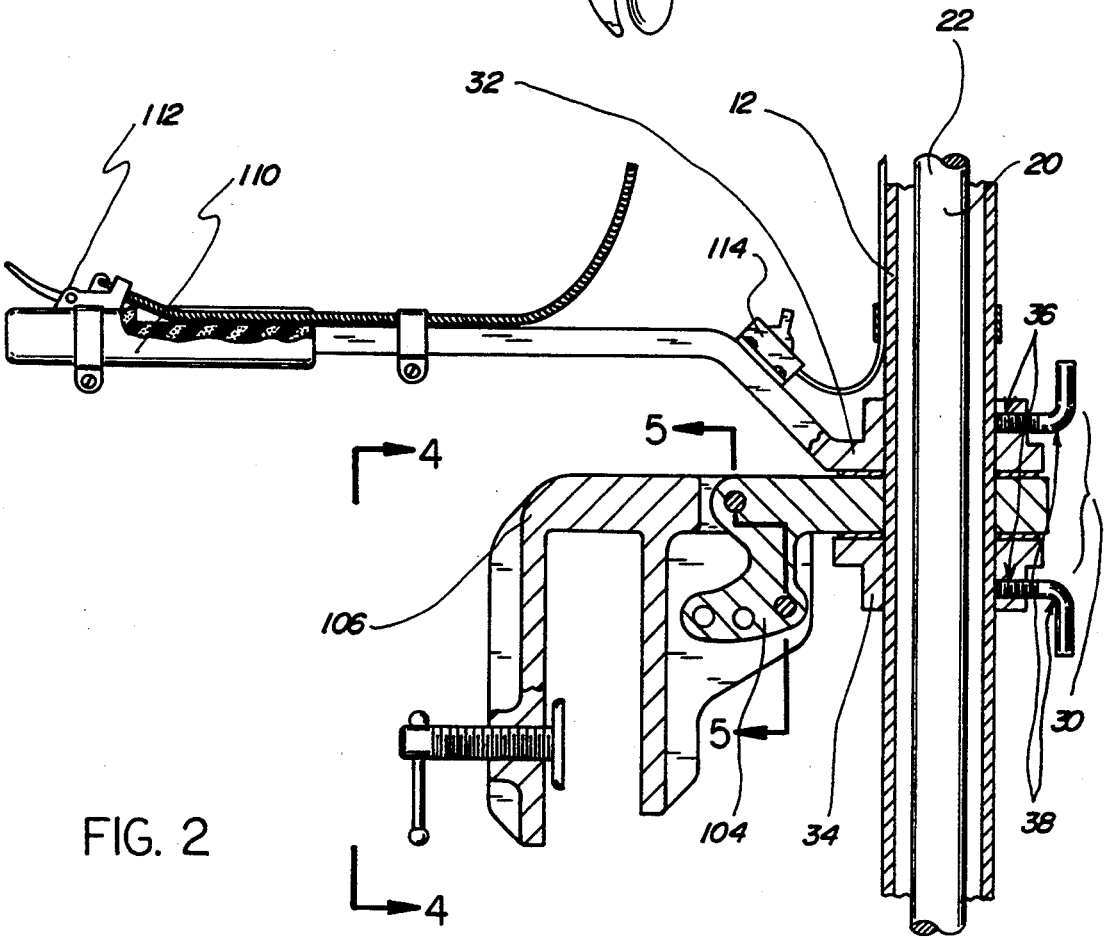
FIG. 2 is a enlarged cross sectional view of the coupling between the tube, collars, and clamp of the present invention.
Figure 5:
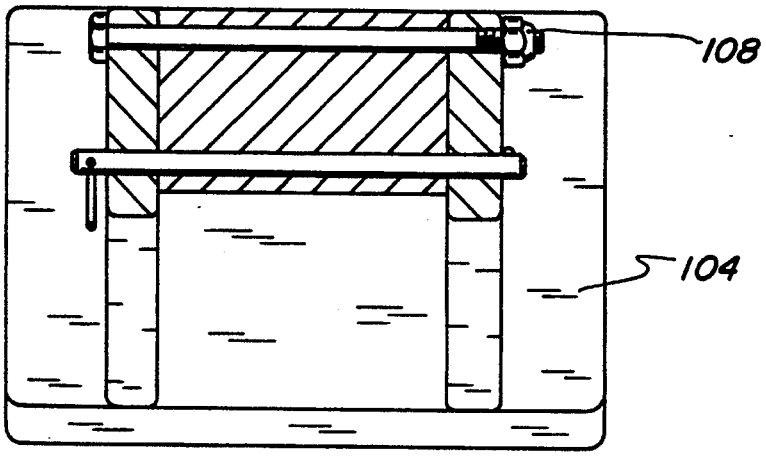
FIG. 5 is a cross sectional view of the coupling between the tilt adjustment member and the U-shaped member taken along the line 5—5 of FIG. 2.
Figure 6:
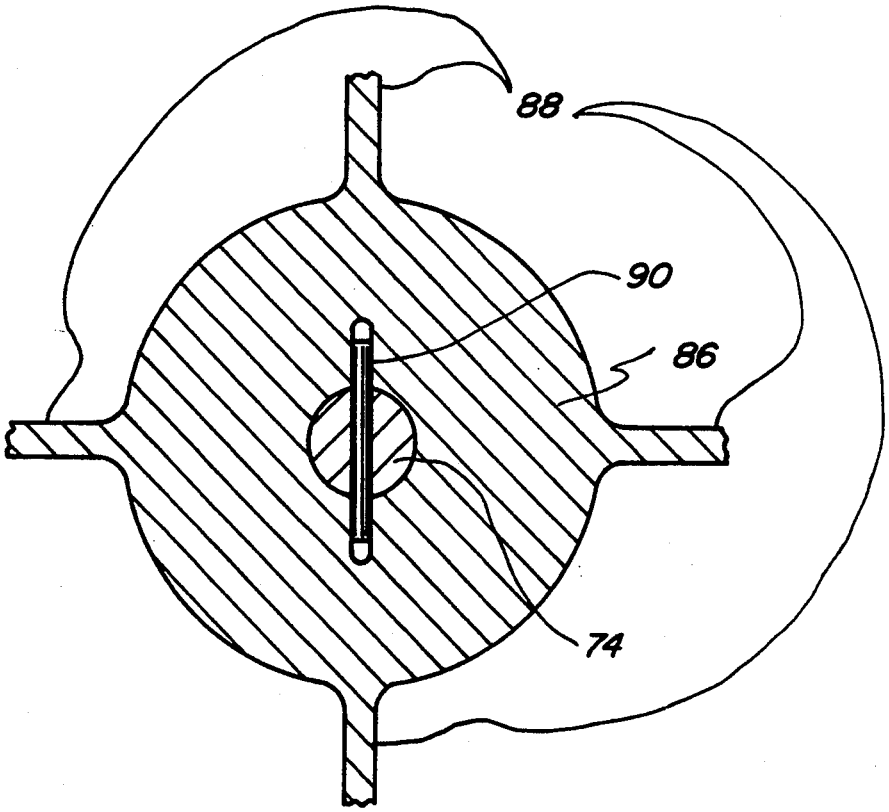
FIG. 6 is a cross sectional view of the coupling between the propeller and the axle taken along the line 6—6 of FIG. 3.

With reference now to the drawings, and in particular, to FIG. 1 thereof, the preferred embodiment of the new and improved boat motor conversion apparatus embodying the principles and concepts of the present invention and generally designated by the reference number 10 will be described.

Specifically, the present invention includes nine major components. The major components are the tube, drive shaft, collar, boat motor, propeller protector, clamp, handle, throttle control, and switch. These components are interrelated to provide the intended function.

More specifically, it will be noted in the various Figures that the first major component is the tube 12. The tube is elongated and rigid in structure. It has an upper end 14 and a lower end 16. The upper end is adapted to be coupled to a motor housing of a line trimmer 18. The tube essentially has the same radial dimension as the original drive shaft housing of the line trimmer. This allows the tube to be mated within the housing of the line trimmer's drive motor without any unnecessary adjustments after the original drive shaft housing is removed.

The second major component is the drive shaft 20. The drive shaft is elongated in structure. It is disposed within the tube 12. The drive shaft has a tip end 22 extending from the upper end 14 of the tube. The drive shaft has a base end 24 extending from the lower end 16 of the tube. The tip end of the drive shaft is adapted to be coupled to a line trimmer's drive motor. When the drive motor is activated, the drive shaft rotates within the tube.

The third major component is the collar 30. The collar is disposed around the tube 12. The collar is adapted to fit snugly around the tube but allow axial movement of the tube upwards or downwards therein. The collar has an upper portion 32 and a lower portion 34. Each portion has a threaded aperture 36 formed thereon and an L-shaped bolt 38 disposed within the aperture. The L-shaped bolt is tightened for coupling the collar with the tube such that the lower end 16 of the tube is placed in an extended position from the collar.

The fourth major component is the boat motor 40. The boat motor comprises thirteen subcomponents. The first subcomponent of the boat motor is a hollow container 42. The hollow container has an essentially concave upper portion 44. An essentially concave lower portion 46 is coupled to the upper portion 44.

The second subcomponent of the boat motor is a central opening 48. The central opening is disposed on the upper portion 44 of the container. The central opening receives the base end 24 of the drive shaft therein.

The third subcomponent of the boat motor is an oblique opening 50. The oblique opening is disposed on the upper portion 44 of the container. The oblique opening is adapted for holding the nozzle of an oil reservoir therein.

The fourth subcomponent of the boat motor is an oil reservoir 52. The oil reservoir is disposed within the container. The oil reservoir is adapted for holding oil for lubricating boat motor subcomponents placed within the reservoir. The oil reservoir has a nozzle 54. The nozzle extends upwards through the oblique opening. The nozzle is adapted for filling the reservoir with oil.

The fifth subcomponent of the boat motor is a first beveled gear 60. The first beveled gear is elongated in structure. It has a toothed portion 62 on one end. It has a rod 64 extending from the toothed portion on the other end. The toothed portion is disposed within the reservoir 52. The rod extends upward from the toothed portion through the reservoir. The end of the rod that is extended through the reservoir is then coupled to the base end 24 of the drive shaft. Rotational movement from the drive shaft can now be transferred to the first beveled gear.

The sixth subcomponent of the boat motor is a first ball-bearing ring 66. The first ball-bearing ring is disposed within the reservoir 52. It is positioned around the rod 64 of the first beveled gear and is placed adjacent to the toothed portion 62 thereof. The first ball-bearing ring allows free rotational movement of the first beveled gear within the container when rotated by the drive shaft.

The seventh subcomponent of the boat motor is a second beveled gear 70. The second beveled gear is elongated in structure. It has a toothed portion 72 on one end. It has a rod 74 extending from the toothed portion on the other end. The toothed portion of the second beveled gear is disposed within the reservoir 52. The second beveled gear is mated with the toothed portion 62 of the first beveled gear. In this configuration, rotational motion directed downward through the first beveled gear is now perpendicularly redirected therefrom with the second beveled gear. The coupling between the gears is lubricated with oil placed in the reservoir. The rod of the second beveled gear is horizontally extended through the reservoir for providing the rotational driving force needed for propelling a boat.

The eighth subcomponent of the boat motor is a second ball-bearing ring 76. The second ball-bearing ring is disposed within the reservoir. It is positioned around the rod 74 of the second beveled gear. It is placed adjacent to the toothed portion 72 of the second beveled gear. The second ball-bearing ring allows rotational movement of the second beveled gear within the reservoir when rotated by the first beveled gear.

The ninth subcomponent of the boat motor is a first seal ring 80. The first seal ring is formed on the oil reservoir 52 and positioned around the rod 64 of the first beveled gear. The first seal ring is also positioned adjacent to the first ball-bearing ring 66. The first seal ring prevents oil from leaking from the reservoir.

The tenth subcomponent of the boat motor is a second seal ring 82. The second seal ring is formed on the oil reservoir 52 and positioned around the rod 74 of the second beveled gear. The second seal ring is also positioned adjacent to the second ball-bearing ring 76. The second seal ring prevents oil from leaking from the reservoir.

The eleventh subcomponent of the boat motor is a propeller 84. The propeller has a housing 86. The housing is disposed about the rod 74 of the second beveled gear. The housing is also positioned adjacent to the second seal ring 82. Four blades 88 extend from the housing. The blades are spaced about the housing to insure adequate propulsion by the propeller when the propeller is rotated.

The twelfth subcomponent of the boat motor is a sheer pin 90. The sheer pin has a first end, a second end, and an intermediate portion therebetween. The first end and the second end are disposed within the housing 86 of the propeller. The intermediate portion is extended therebetween and disposed through the rod 74 of the second beveled gear. The sheer pin is thus used as a moment arm for translating rotational movement from the second beveled gear to the propeller, whereby generating propelling forces.

The thirteenth subcomponent of the boat motor is a cap 92. The cap is coupled to the end of the rod 74 of the second beveled gear. The cap is used to secure the propeller onto the rod of the second beveled gear.

The fifth major component is the propeller protector 100. The propeller protector is coupled to the lower portion 46 of the container. The propeller protector extends downwards from the lower portion of the container. The propeller protector is used to protect the rotating propeller 84 from damage that could be inflicted thereon by rocks, weeds and other obstacles in the water.

The sixth major component is the clamp 102. The clamp has a first member 104 coupled to the collar 30. The clamp also includes a downwardly extending and U-shaped second member 106. A pivot 108 is disposed between the first member and the U-shaped second member. The pivot enables the first member to be pivoted relative to the second member. The second member has a pair of clamping screws 110 threadably coupled thereto. The clamping screws are adapted for securing the stern of a boat within the second member.

The seventh major component is the handle 110. The handle is coupled to the upper portion 32 of the collar. The handle allows the boat motor to be rotated sideways. The handle also allows the boat motor to be pivoted upwards and downwards with respect to the pivot 108 of the clamp. This allows the propelling forces from the propeller to be directed in a plurality of ways, thus allowing a boat to be propelled to its intended location.

The eighth major component is the throttle control 112. The throttle control is coupled to the handle 110. The throttle is adapted for controlling the drive motor of a line trimmer. The throttle thereby controls the propelling force delivered by the boat motor.

The ninth major component is the switch 114. The switch is coupled to the handle 110. The switch is adapted for deactivating the drive motor of a line trimmer. The switch thereby terminates the propelling force delivered by the boat motor.

Conventional line trimmers can be converted to boat motors following a sequence of steps. First, a line trimmer must be obtained. Next, the trimmer head of the line trimmer is removed. The throttle is then removed from the line trimmer's drive shaft housing. The line trimmer's drive shaft is then disengaged from the drive motor housing to expose the line trimmer's drive shaft. The line trimmer's drive shaft is then removed. The drive shaft and accompanying tube of the boat motor conversion apparatus is then coupled to the drive motor of the line trimmer. The drive shaft of the boat motor conversion apparatus is coupled to the drive motor, and the tube is coupled to the drive motor housing. The throttle of the line trimmer is then coupled to the tube of the boat motor conversion apparatus. Finally, the switch for deactivating the boat motor conversion apparatus is then coupled between the line trimmer's drive motor and the drive shaft of the boat motor conversion apparatus.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A boat motor conversion apparatus for converting a line trimmer into a boat motor comprising, in combination:

an elongated and rigid tube having an upper end and a lower end, the upper end adapted to be coupled to a line trimmer's motor housing;

an elongated drive shaft disposed within the tube, the drive shaft having a tip end extending from the upper end of the tube and a base end extending from the lower end of the tube, the tip end adapted to be coupled to a line trimmer's drive motor, whereby the drive motor rotates the drive shaft within the tube when activated;

a collar disposed around the tube and allowing axial movement of the tube upwards or downwards, the collar having an upper portion and a lower portion, each portion having a threaded aperture formed thereon and an L-shaped bolt disposed therein for coupling with the tube such that the lower end of the tube is placed in an extended position from the collar;

a boat motor further comprising:

a hollow container having an essentially concave upper portion secured to an essentially concave lower portion;

a central opening disposed on the upper portion of the container for receiving the base end of the drive shaft therein;

an oblique opening disposed on the upper portion of the container and adapted for holding the nozzle of a oil reservoir therein;

an oil reservoir disposed within the container for holding oil for lubrication, the oil reservoir having a nozzle extending upwards through the oblique opening, the nozzle adapted for filling the oil reservoir with oil;

an elongated first bevelled gear having a toothed portion on one end and a rod on the other end, the toothed portion disposed within the oil reservoir, the rod upwardly extended from the toothed portion through the oil reservoir and coupled to the base end of the drive shaft;

a first ball-bearing ring disposed within the oil reservoir and positioned around the rod of the first bevelled gear adjacent to the toothed portion thereof for allowing rotational movement of the first bevelled gear within the container when rotated by the drive shaft;

an elongated second bevelled gear having a toothed portion on one end and a rod on the other end, the toothed portion of the second bevelled gear disposed within the oil reservoir and mated with the toothed portion of the first bevelled gear for perpendicularly redirecting rotational movement therefrom, the rod horizontally extended through the oil reservoir;

a second ball-bearing ring disposed within the oil reservoir and positioned around the rod of the second bevelled gear adjacent to the toothed portion thereof for allowing rotational movement of the second bevelled gear within the oil reservoir when rotated by the first bevelled gear;

a first seal ring formed on the oil reservoir and positioned around rod of the first bevelled gear adjacent to the first ball-bearing ring for preventing oil from leaking from the oil reservoir;

a second seal ring formed on the oil reservoir and positioned around rod of the second bevelled gear adjacent to the second ball-bearing ring for preventing oil from leaking from the oil reservoir;

a propeller having a housing disposed about the rod of the second bevelled gear adjacent to the second seal ring and four blades extending therefrom;

a shear pin having a first end, a second end, and an intermediate portion therebetween with the first end and second end disposed in the housing of the propeller and the intermediate portion disposed through the rod of the second bevelled gear, the shear pin translating rotational movement from the second bevelled gear to the propeller, whereby generating propelling forces; and a cap coupled to the end of the rod of the second bevelled gear, thus securing the propeller thereto;

a propeller protector coupled to the lower portion of the container and extending downwards therefrom for protecting the rotating propeller from damage;

a clamp having a first member coupled to the collar, a downwardly extending U-shaped second member, and a pivot therebetween, the second member having a pair of clamping screws threadably coupled thereto, the clamping screws adapted for securing the stern of a boat within the second member;

a handle coupled to the upper portion of the collar for allowing the boat motor to be rotated sideways and pivoted upwards and downwards with respect to the pivot of the clamp;

a throttle control coupled to the handle and adapted for controlling the line trimmer's drive motor; and a switch coupled to the handle and adapted for deactivating the line trimmer's drive motor.

* * * * *